US008720710B2

(12) United States Patent
Smith

(10) Patent No.: US 8,720,710 B2
(45) Date of Patent: May 13, 2014

(54) MAGNETICALLY ACTUATED MODEL RAILROAD COUPLER

(75) Inventor: David K. Smith, Toms River, NJ (US)

(73) Assignee: NZT Products, LLC, Toms River, NJ (US)

( * ) Notice: Subject to any disclaimer, the term of this patent is extended or adjusted under 35 U.S.C. 154(b) by 66 days.

(21) Appl. No.: 13/437,029

(22) Filed: Apr. 2, 2012

(65) Prior Publication Data

US 2013/0256254 A1 Oct. 3, 2013

(51) Int. Cl.
*A63H 19/18* (2006.01)

(52) U.S. Cl.
USPC ..... 213/75 TC

(58) Field of Classification Search
USPC ..... 213/75 TC
See application file for complete search history.

(56) References Cited

U.S. PATENT DOCUMENTS

| | | | | |
|---|---|---|---|---|
| 450,356 | A | 4/1891 | Green | |
| 2,409,920 | A | 10/1946 | Wicher | |
| 2,617,541 | A | 11/1952 | Goode | |
| 3,469,713 | A | 9/1969 | Edwards et al. | |
| 5,620,106 | A | 4/1997 | Storzek | |
| 5,662,229 | A | 9/1997 | Edwards | |
| 5,785,192 | A | 7/1998 | Dunham et al. | |
| RE38,990 | E | 2/2006 | Staat | |
| 6,994,224 | B2 | 2/2006 | Barger et al. | |
| 7,810,660 | B1 | 10/2010 | Dunham | |
| 8,127,952 | B2 * | 3/2012 | Grubba | 213/75 TC |
| 2011/0036800 | A1 | 2/2011 | Ito et al. | |

FOREIGN PATENT DOCUMENTS

JP 2002-331177 11/2002

OTHER PUBLICATIONS

Written Opinion, Int'l Appln. PCT/US2013/03779, Mar. 17, 2013.
"Proto: HO Accumate Instructions", Accurail's Accumate Coupling System, 2000, from http://www.accurail.com/accurail/accumate.htm and http://www.accurail.com/accurail/parts.htm (last visited Mar. 1, 2012).
Smith, David K., "Z-Scale Truck and Coupler Review," The James River Branch, 2010 (from http://jamesriver.net/clinic2.htm (last visited Mar. 1, 2012).
"Knuckle Couplers," from http://members.cox.net/mrobbins1/Couplers.pdf (last visited Mar. 1, 2012).
"McHenry Coupler #51," from http://www.mchenrycouplers.com/mch051.htm (last visited Mar. 1, 2012).
"Evolution of the Magne-Matic Coupler," from http://www.microtrains.com//magne-matic.php (last visited Mar. 1, 2012).

* cited by examiner

*Primary Examiner* — Zachary Kuhfuss
(74) *Attorney, Agent, or Firm* — David M. Quinlan, P.C.

(57) ABSTRACT

A model railroad car coupler assembly comprises a coupler with an upper shank having a coupler knuckle at a distal portion and a flat proximal portion, a lower shank having a coupler thumb at a distal portion and a flat proximal portion, and a coil spring terminating in first and second end portions, with a first turn of the coupler spring interlocked with the upper shank and a second turn interlocked with the lower shank. A mounting box has a circular mounting post that accepts circular openings in the shanks permitting them to rotate relative to each other between a closed coupled position and an open uncoupling position. The spring end portions engage the mounting box to bias the shanks into their coupled position. The knuckle carries a ferrous actuating pin that cooperates with a magnetic pad along a track to rotate the upper shank into its open position.

19 Claims, 7 Drawing Sheets

MAGNETICALLY ACTUATED MODEL RAILROAD COUPLER

BACKGROUND OF THE INVENTION

1. Field of the Invention

The present invention relates generally to couplers for model railroad rolling stock, and more particularly, to such couplers that can be remotely coupled and uncoupled, provided in small scales, and made to closely resemble full scale railroad couplers in operation and appearance.

2. Description of Related Art

Model railroad equipment comes in many scales, some of the most popular of which result in extremely small replicas of full scale railroad equipment. Avid model railroaders insist on realism, in both operation and appearance, regardless of how small their scale model equipment is. For the most part, it is a fairly simple matter to reduce the scale of railroad rolling stock and accessories such as scenery items and buildings used in layouts that simulate an actual landscape. However, couplers for the rolling stock present a special challenge when reducing them to sizes compatible with scales commonly used in model railroading.

Model railroads can come in extremely small scales. For example, N scale is 1:160, which is about one-half the size of the HO scale (1:87) more familiar outside model railroading circles, and Z scale is even smaller (1:220). Smaller scales enable simulation in the same amount of space of a more elaborate and diverse landscape, with the result that N and Z scales have become very popular with model railroading enthusiasts. Providing a properly functional coupler that is as realistic as possible becomes a serious challenge as the scale gets smaller. Model railroad layouts must be capable not only of realistically duplicating the appearance of a full-scale landscape, but all of the railroad components themselves, including couplers, should also be capable of simulating the operation of a full-scale railroad to the greatest extent possible. This requires that the model railroader operating a layout be able to assemble various items of rolling stock into trains, disassemble trains, store rolling stock in a simulated train yard that is part of the layout, retrieve stored rolling stock to incorporate into a train when desired, and otherwise provide a realistic railroading experience. Obviously, this involves performing coupling and uncoupling operations and moving coupled and uncoupled rolling stock to desired locations in the layout. Preferably, the couplers permit coupling and uncoupling rolling stock to be performed at a distance remote from a central control location where the operator of the model railroad layout might be running multiple trains at any given time.

Model railroad couplers are generally available commercially in essentially three different styles. One popular style is the Magne-Matic® coupler marketed by Micro-Trains Line Co. of Talent, Oreg., the construction of which coupler is exemplified by U.S. Pat. No. 3,469,713. This type of coupler is known as a split-shank coupler, because it has two separate shanks, one carrying a coupler knuckle and the other carrying a coupler lip. The shanks are pivotably mounted to permit the rolling stock to follow curved track portions without derailing. The pivotal mounting also allows the two shanks to move relative to each other to separate the coupling parts (the knuckle and lip) and effect coupling/uncoupling operations like those discussed above and in more detail further below in connection with the present invention.

The Magne-Matic® coupler can carry out remote coupling/uncoupling operations effectively and reliably. However, the spring system used to bias the shanks centrally of a coupler housing during straight-line travel of the rolling stock, and also into a coupled state in which the coupler parts are in their closed positions, has a significant amount of "play" in the direction of train movement. This can be appreciated from, say, FIG. 6 of the '713 patent, which shows a smaller diameter mounting post (40) within larger central openings in the shanks (50,54). In a commercial model of this coupler the resulting space allows from about 0.010" to 0.020" of relative motion between the shanks and the post. One issue arises because various train operations exert a force on the coupled railroad cars tending to separate them in the direction of train travel. While the couplers prevent the railroad cars from actually separating, the space between the mounting post and the shanks' central openings can delay the motion of subsequent cars in a train when a locomotive begins to pull on the first car. For example, if a train is 50 cars long, the first car might have to travel as much as 1-2" (0.010" to 0.020" times 100—there being two couplers per car) before the last car begins to move. In addition, the train can undergo a cyclical telescoping motion because the biasing compression springs contract and expand while the train is moving, which can cause periodic lengthening and contracting of the train known to modelers as the "Slinky" effect (after the familiar Slinky® spring toy). Another issue with Magne-Matic® couplers is that the shanks and mounting box must be long enough to accommodate the biasing spring, which can cause the coupler to protrude an excessive distance from certain types of model rolling stock and detract from a realistic appearance.

A second popular coupler style is also a split-shank coupler, sold by Accurail Inc. of Elburn, Ill., under the Accumate® brand, one type of which is shown in FIG. 1 (from a document available at http://www.accurail.com/accurail/parts.htm). This coupler has an upper shank US that carries a coupler lip L and a lower shank LS that carries a coupler knuckle K. Each shank has an opening O that fits over a post P when the coupler is assembled into the mounting box B and a biasing spring BS that bears against an inside surface of the mounting box B. Each shank is also independently pivotable about an axis defined by the post P, so that the springs BS center the shanks in the box for straight-line travel of coupled rolling stock, and at the same time allow the shanks to pivot independently to perform an uncoupling operation when a magnetically operated actuation pin AP causes rotation of the lower shank LS to which it is attached.

This coupler style is acceptable to a large number of railroad modelers, but it too has drawbacks. For one thing, the biasing springs BS are molded as integral parts of the plastic shanks US and LS. Being plastic, the springs generally lose their resilience over time, which can affect the operation of the coupler. It is also difficult to mold a plastic leaf spring like the biasing springs BS so that it has a spring constant within acceptable tolerances for proper coupler operation. For example, if the springs are too stiff they can impede the ability of the coupler to pivot as the small, light-weight model rolling stock travels curved track sections, thus making the train prone to derailing. In addition, a plastic spring tends to have a "memory" that will preserve at least some of a deformation imposed on the spring for a long period, such as when a train is parked on a section of curved track for an extended time. This can impair subsequent operation of the train (since the permanently deformed biasing springs will impose a lateral force on the rolling stock when it is on a section of straight track), and can affect coupling/uncoupling operations as well.

Another drawback of this coupler style is that having the lip L on the upper shank somewhat affects the ability of the coupler to be made to look as realistic as it might otherwise be if the knuckle-bearing shank were on top, as shown in Accurail U.S. Pat. No. 5,620,106. However, the coupler in the '106 patent is not remotely actuatable, largely because the lower shank (13) is too thin to hold an actuating pin (AP in FIG. 1) in place against the torque applied to it during an automatic uncoupling operation. As seen in FIG. 1, with the knuckle-bearing shank on the bottom, the actuating pin AP can be secured in a relatively thick knuckle section using a keying arrangement, such as the flat portions at the top of the actuating pin AP, to prevent relative rotation between the pin and the knuckle.

A third popular model railroad coupler style on the market today is sold by McHenry Couplers of Long Beach, Calif. This coupler has a single shank with a proximal end pivotably mounted to a piece of rolling stock and a rotatable, spring-biased knuckle forming a coupler at a distal end of the shank. Centering springs at the proximal end of the shank urge the coupler into a position aligned with the rolling stock's longitudinal centerline, while also permitting the shank to deflect from side-to-side as discussed above to enable coupled rolling stock to negotiate curved track sections. Reference may be made to U.S. Pat. No. 5,662,229 and U.S. Pat. No. RE38,990 to see certain features of this type of coupler, although neither patent exactly depicts the structure of commercially available McHenry™ couplers.

Although McHenry™ couplers have proved popular among modelers, they also present certain problems. The commercial version of the coupler has plastic centering springs somewhat like those shown in the '990 patent, which are of course subject to the drawbacks of plastic springs discussed above. In addition, the coupler knuckle is biased into the closed position by a large external spring that detracts from the realistic appearance of the coupler, as shown in FIG. 2, which is a photograph of a commercially available McHenry™ coupler (from "Knuckle Couplers" at http://members.cox.net/mrobbins1/Couplers.pdf). Compare FIG. 2 with FIG. 3, which is a photograph of an actual railroad coupler. It will be readily apparent that the model version (FIG. 2) is not a particularly accurate replica of the actual coupler (FIG. 3).

In addition to the drawbacks of the three magnetically actuated coupler styles generally available commercially to modelers today, the only one of the three available for Z scale rolling stock is the Magne-Matic® coupler, which has the issues discussed above. There are patents that describe couplers that seek to ameliorate some of the drawbacks noted above with other style couplers. For example, U.S. Pat. No. 5,662,229 uses metal centering springs for a McHenry style coupler, in an attempt to avoid problems caused by plastic springs, but according to the patent the described design appears to be particularly adapted for HO scale. With smaller rolling stock, especially Z scale, it is believed that manufacturers and modelers would find it difficult as a practical matter to reliably attach thin wire centering springs to a mounting plate as shown in the '229 patent. U.S. Pat. No. RE38,990 replaces with a cantilever spring the unsightly external coil spring of commercially available McHenry style couplers, but so far as is known the operability of such a design has not been established, and it still does not provide a completely realistic looking coupler. Finally, U.S. Pat. No. 6,994,224 replaces the McHenry external coil spring with a spring located out of sight inside the coupler knuckle. However, the extremely small dimensions necessary in Z scale (or even N scale) probably make this design impracticable for these smaller scales.

Accordingly, there is a need for a model railroad coupler, particularly for N scale and Z scale rolling stock, that is remotely actuatable, reliable, avoids the necessity of using plastic springs, and can be made as realistic as possible in both operation and appearance.

SUMMARY OF THE INVENTION

It is an object of the present invention to improve known model railroad couplers, particularly magnetically actuated couplers. It is a particular object of the invention to provide a construction that can be reduced in size to smaller scales, while still being reliable in operation and realistic in appearance.

In accordance with one aspect of the disclosed embodiments that fulfills various objects of the invention, a coupler for a model railroad car comprises a first shank with a distal portion having a first coupler member and a proximal portion with a mounting arrangement for mounting the first shank to the railroad car for rotation about an axis generally transverse to the direction of travel of the railroad car along a track provided therefor, a second shank with a distal portion having a second coupler member and a proximal portion with a mounting arrangement for mounting the second shank to the railroad car for rotation about an axis generally transverse to the direction of travel of the model railroad car along the track, wherein the first and second shanks are rotatable relative to each other about an axis transverse to the direction of travel of the model railroad car along the track, the first and second shanks being rotatable between a closed position in which the coupler members cooperate with a coupler on another model railroad car to couple the railroad cars together and an open position in which the coupler members permit the railroad cars to separate, and a coil spring with an axis generally parallel to the axes of rotation of the first and second shanks and having a first turn interlocked with the first shank and a second turn interlocked with the second shank, the first and second turns terminating in respective first and second end portions for engaging structure on the railroad car to bias the first and second shanks into their closed position.

In another aspect, such a coupler further includes a magnetic actuating pin mounted on one of the first and second shanks for causing rotation thereof against the biasing force of the spring when a railroad car to which the coupler is mounted is at a location on the track with the actuating pin proximate to a magnetic actuating pad. A coupler with the described structure can be made more realistic looking than previously known couplers in very small scales, and can be easily retrofit to existing model rolling stock. It is possible with the present construction to have the first shank comprise a coupler knuckle and be disposed on top of the second shank, with the actuating pin mounted to the first shank, thereby making it possible to provide a coupler capable of realistic remote operation without sacrificing a realistic appearance.

Yet another aspect of the disclosed embodiments resides in a coupler assembly that includes a (i) first shank comprising a distal portion with a coupler knuckle and a proximal portion including a flat portion having a circular outer surface and a concentric circular opening, (ii) a second shank comprising a distal portion with a coupler thumb and a proximal portion including a flat portion having a circular outer surface with a radius substantially the same as the radius of the circular outer surface of the first shank flat portion and a concentric circular opening the center of which substantially coincides with the center of the circular opening in the first shank, (iii) a coil spring with a circular planform having a first turn and a second turn terminating in respective first and second end portions, the first turn including a first interlocking offset that passes through an opening in the first shank and the second turn including a second interlocking offset that passes through an opening in the second shank, and the flat portions of the first and second shanks including spring grooves accepting the coil spring to permit the flat portions to lie in face-to-face contact, wherein the coil spring has a radius slightly larger than the radius of the circular outer surfaces of the first and second shanks so that the first and second turns of the coil spring are disposed outside the periphery of the circular outer surfaces, and (iv) a mounting box for mounting to the railroad car and having a circular mounting post with an upright axis generally perpendicular to the direction of travel of the model railroad car along a track and generally perpendicular to a plane of the track when the model railroad car is in place thereon, the mounting post accepting the circular openings in the first and second shanks for permitting rotation of the shanks relative to each other about the upright axis between a closed position in which the knuckle and thumb cooperate with a coupler on another model railroad car to couple the railroad cars together and an open position in which the knuckle and thumb permit the railroad cars to separate, wherein the first and second end portions of the coil spring engage the mounting box to bias the shanks into their closed position and into a position in which the shanks are generally aligned with the direction of travel of the model railroad car along the track.

Such an assembly provides a mounting box that holds the coupler and that can be readily secured to existing rolling stock to replace previously mounted, less realistic couplers. Further, various features of the coupler described further above, and in the description of embodiments that follows, can be incorporated into the coupler assembly to enable more realistic looking couplers with more realistic operational characteristics to be retrofit to a wide variety of existing rolling stock.

This Summary is provided to introduce in a simplified form a selection of concepts relating to the subject matter described herein that are further described below in the Detailed Description of Preferred Embodiments. It is not intended necessarily to identify key or essential features of the invention, nor as an aid in determining the scope of the claimed subject matter.

BRIEF DESCRIPTION OF THE DRAWINGS

The objects of the invention are not limited by the description above, and all of the objects and advantages of the invention will be better understood from the detailed description of its preferred embodiments which follows below, when taken in conjunction with the accompanying drawings, in which like numerals and letters refer to like features throughout. The following is a brief identification of the drawing figures used in the accompanying detailed description.

One skilled in the art will readily understand that the drawings are not strictly to scale, but nevertheless will find them sufficient, when taken with the detailed descriptions of preferred embodiments that follow, to make and use the present invention.

DETAILED DESCRIPTION OF PREFERRED EMBODIMENTS

Figure 4:
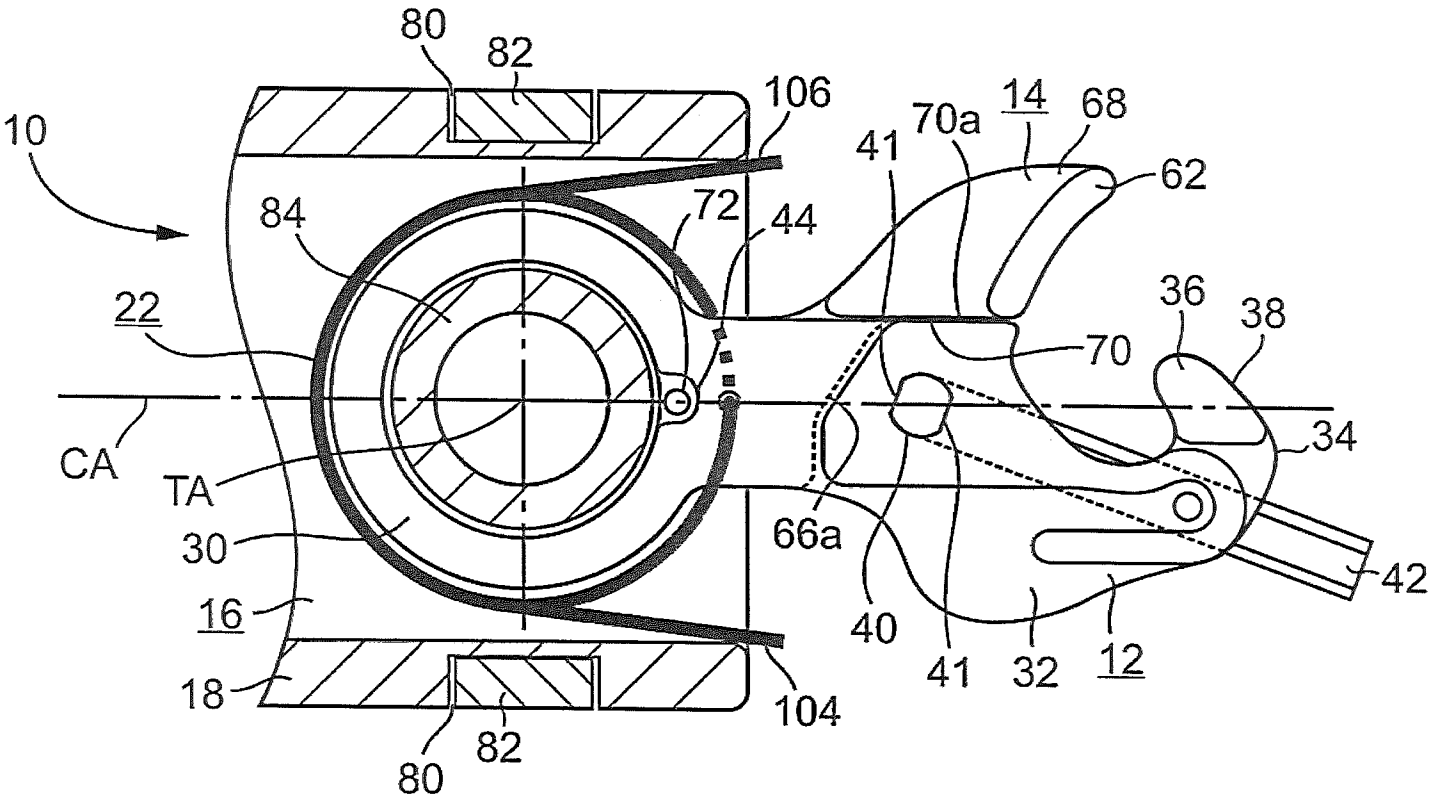
FIG. 4 is a top view of a model railroad coupler according to a preferred embodiment of the present invention, in which certain structure for mounting the coupler to a model railroad car is shown schematically.
Figure 5:
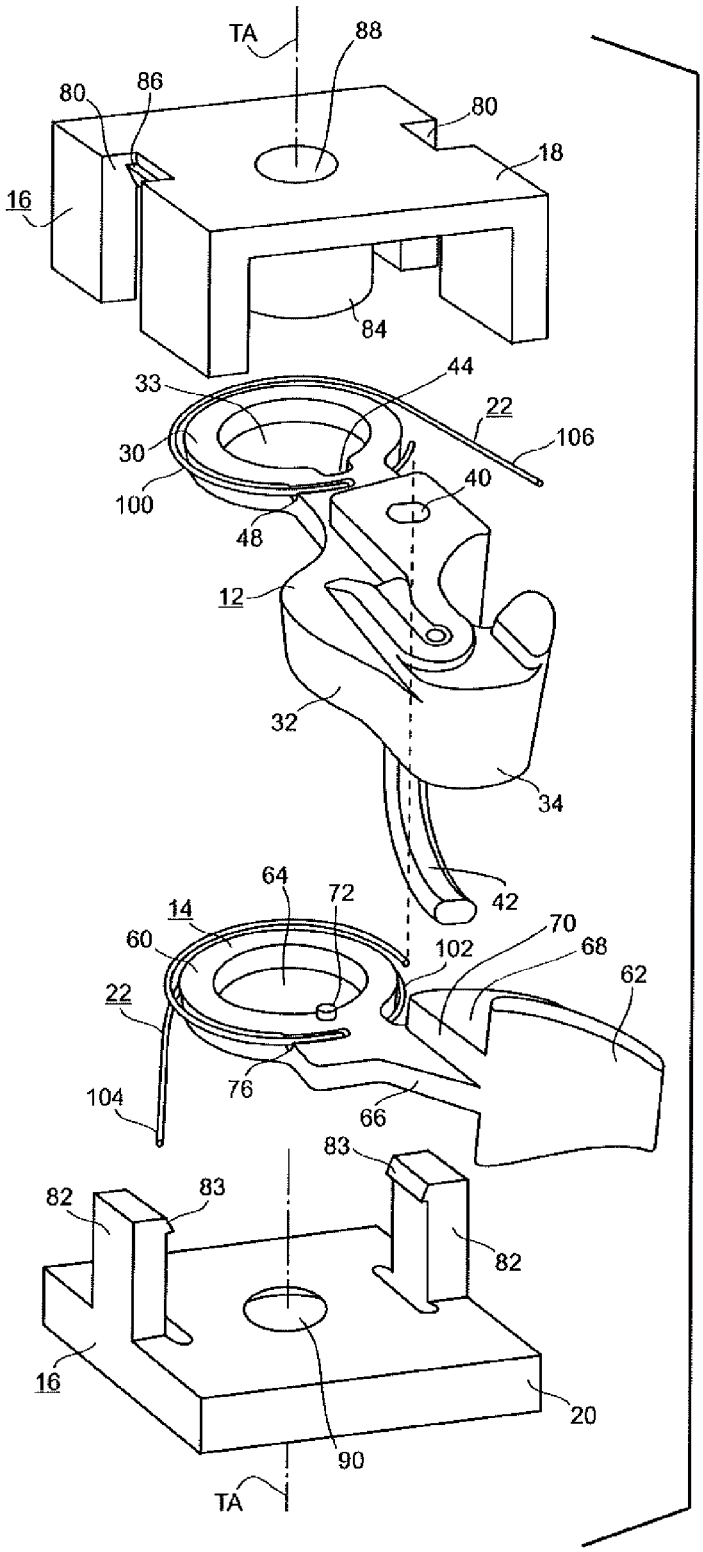
FIG. 5 is an exploded perspective view of a coupler according to a preferred embodiment of the invention.
Figure 6:
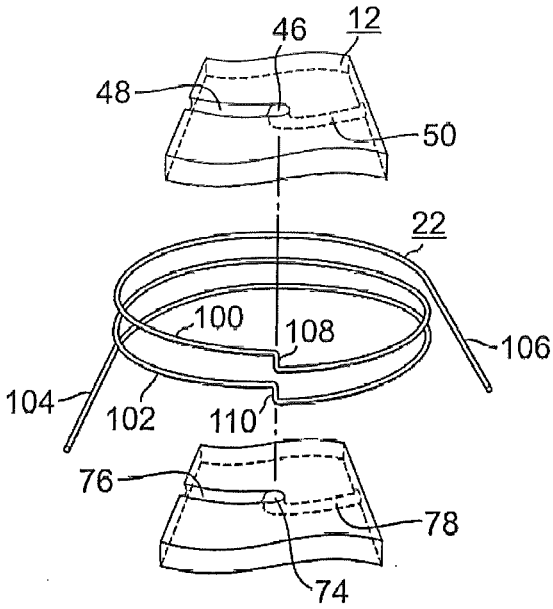
FIG. 6 is an exploded perspective view illustrating details of the spring-shank interlocking structure in accordance with the embodiment of the invention depicted in FIGS. 4 and 5.

With reference to FIGS. 4 to 6, a coupler assembly 10 according to a preferred embodiment of the present invention includes a coupler with an upper first shank 12 and a lower second shank 14. The assembly includes a mounting box 16, with an upper first section 18 and a lower second section 20, that mounts the coupler to a model railroad car. The coupler further includes a coil biasing/centering spring 22 that cooperates with the mounting box and the shanks in a unique manner. In describing embodiments of the invention, terms indicating direction or orientation, such as "lower," "upper," "top," "bottom," etc., may be used to facilitate the description. The use of such terms does not imply that the invention is limited to a particular orientation of the structure being described. Also by way of definition, it should be understood that the term "railroad car" as used herein is not limiting and unless specifically stated otherwise, is meant to include any item of railroad rolling stock, such as a passenger carriage, a freight car, a locomotive, a caboose, and any other example of rolling stock that can include a coupler for coupling it to another item of rolling stock of whatever type or kind.

Figure 2:
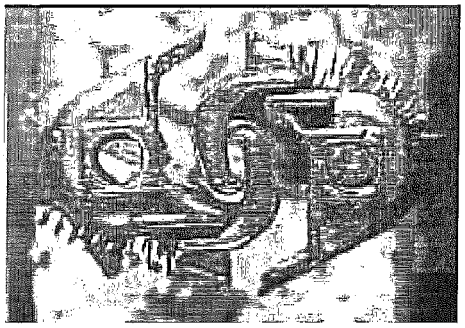
FIG. 2 (PRIOR ART)
FIG. 2 is a photograph of a commercially available McHenry™ coupler taken looking down at the coupler.
Figure 3:
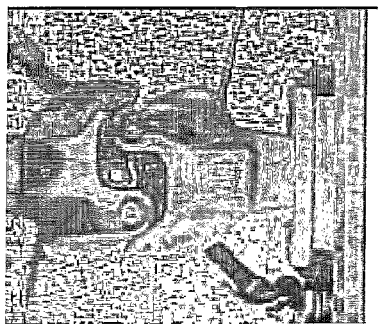
FIG. 3 (PRIOR ART)
FIG. 3 is a photograph of an actual real railroad coupler taken looking down at the coupler.

The exploded perspective view of FIG. 5 shows in more detail the configuration of the various coupler and coupler assembly parts and how they are assembled according to the present embodiment of the invention. The upper first shank 12 has a flat proximal portion 30 and a distal knuckle portion 32 that provides a first coupler member. In a preferred embodiment the first shank is integrally molded in one piece of a suitable plastic material such as Delrin® polymer or other acetyl plastic. The flat proximal portion 30 has a generally circular outer periphery that presents a circular outer surface and a generally circular opening 33 concentric with its outer periphery. The distal knuckle portion 32 of the upper first shank 12 comprises a thicker coupler knuckle that has a rounded distal end 34 and a knuckle extension 36 presenting a distal surface 38 that functions as a camming surface in a manner described further below. It will be readily apparent that the top surface of the knuckle in FIGS. 4 and 5 can be molded to closely resemble any desired style of actual railroad coupler, and that the depicted embodiment of the present invention provides a model coupler manufacturer great latitude in making couplers with features that duplicate to a high degree of realism even the smallest features of actual railroad couplers. Moreover, FIG. 4 shows that a coupler according the present invention can be made without a prominently visible external spring like the prior art McHenry™ coupler shown in FIG. 2.

Figure 1:
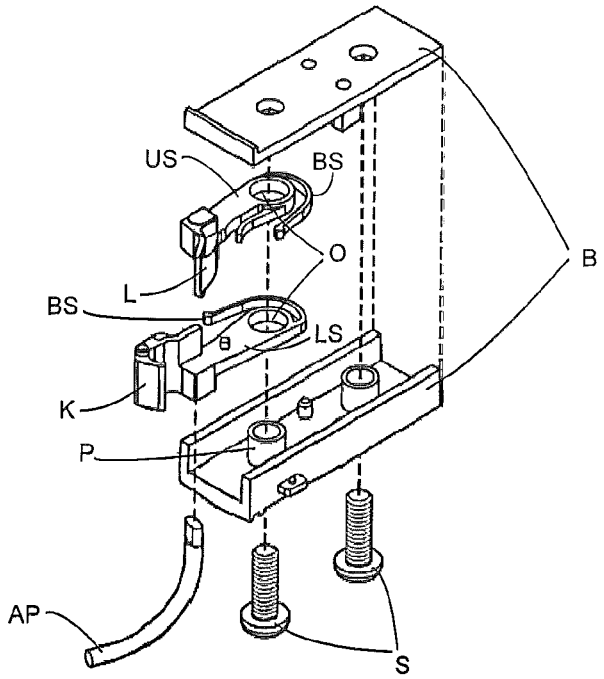
FIG. 1 (PRIOR ART)
FIG. 1 is an exploded perspective view of the prior art Accumate® coupler discussed above.

The knuckle portion 32 also has an opening 40 that accepts an actuating pin 42. The actuating pin is made of a suitable ferrous material, preferably a corrosion-resistant alloy such as AISI grade 4xx ferritic stainless steel, so that it will be attracted by a magnet to effect an automatic uncoupling operation as described in detail further below. The opening has elongated flat sides 41 that form a keying arrangement with cooperating flat sides on the top end of the actuating pin, similar to the mounting of the actuating pin in the Accumate® brand coupler shown in FIG. 1. However, in the present invention embodiment of FIGS. 4 and 5 the thicker knuckle mounting the actuating pin is on top, which allows the coupler 10 to have a more realistic appearance. By way of further explanation of this feature, operation of the coupler subjects the actuating pin 42 to a certain amount of torque tending to twist it in the opening 40. The actuating pin for magnetically operated model couplers is typically attached to the plastic coupler part (the knuckle in the Accumate® coupler and the present embodiment of the invention) by an interference fit. That is, the keyed top of the actuating pin is slightly larger than the opening in the knuckle that accepts the pin. This type of connection is preferable because the parts are so small that using an adhesive alone will have limited effectiveness in counteracting the torque placed on the adhesive pin, especially with smaller scales. And the effectiveness of an adhesive is even further reduced if the knuckle is made of acetyl plastic (see above), which is known to be extremely difficult to bond, particularly to metals. Accordingly, the coupler of the present embodiment permits the actuating pin to be attached to the thicker coupler knuckle, which can be made part of the upper shank to increase the realistic appearance of the coupler 10.

The upper first shank 12 further includes a cutout 44 at the inner surface of the opening 33. In the present embodiment the cutout is generally semicircular for ease of manufacturing and is located on the longitudinal axis CA of the coupler 10. The coupler axis CA coincides with the direction of movement of the rolling stock on which the coupler is mounted, as described below in connection with FIG. 7. Other features of the upper first shank include a spring-interlock opening 46 that connects to an upper spring groove 48 and a lower spring groove 50 (see FIG. 6) for a purpose described further below.

The lower second shank 14 includes a flat proximal portion 60 and a distal thumb portion 62 that provides a second coupler member. In a preferred embodiment the second shank is integrally molded in one piece of a suitable plastic material, preferably the same material that is used for the first shank 12. The flat proximal portion 60 has a generally circular outer periphery that presents a circular outer surface and a generally circular opening 64 concentric with its outer periphery. The radii of the circular outer periphery of the proximal portion 60 and of the opening 64 substantially match the radii of the upper first shank's flat proximal portion 30 and opening 33, respectively. A portion of the lower second shank 14 between the proximal and distal ends forms an upright surface 66 angled obliquely relative to the coupler longitudinal axis CA. The distal end of the lower shank further includes a thickened portion 68 that presents another upright surface 70 generally aligned with the longitudinal axis CA when the coupler is in its closed state as shown in FIG. 4. The surface 70 cooperates with the side surface 70*a* of the knuckle, as seen in FIG. 4, to form a positive stop that establishes the closed state of the knuckle portion 32 and the thumb portion 62 against the action of the spring 22, as described in more detail below. The surface 66 defines a cutout in the lower second shank that accepts a portion of the knuckle 12 defined in part by the oblique surface 66*a* molded into its lower side (see FIG. 4). This arrangement permits the top surface of the knuckle portion 12 to lie flush with the top surface of the thickened portion 68 of the thumb portion 62, which can be appreciated from FIG. 4. Likewise, these cooperating contours molded into the knuckle portion and thumb portion also permit their bottom surfaces to lie flush with each other, as seen more clearly in FIG. 7.

The lower second shank 14 further includes an upstanding pin 72 on its upper surface proximate to the opening 64. The pin 72 fits in the cutout 44 of the upper first shank 12 when the coupler is assembled, as shown in FIG. 4, with the surfaces of the flat proximal portions 30 and 60 in face-to-face contact. The pin 72 is slightly smaller in diameter than the width of the cutout 44 (in the circumferential direction) to provide a lost-motion connection between the upper and lower shanks for reasons related to the operation of the coupler described in more detail below. Other features of the lower second shank include a spring-interlock opening 74 that connects to an upper spring groove 76 and a lower spring groove 78 (see FIG. 6) for a purpose to be described.

Figure 7:
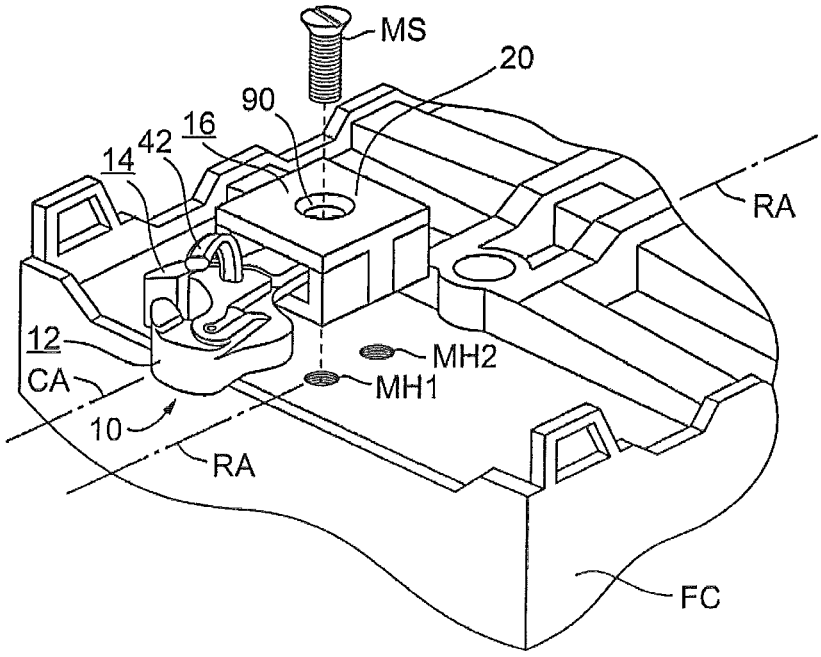
FIG. 7 illustrates an arrangement for mounting a coupler in accordance with an embodiment of the present invention to a model railroad freight car. It also affords a view of the bottom of the coupler showing how various parts thereof are oriented relative to each other.

The structure of the mounting box 16 is best seen in FIG. 5, although reference to FIG. 7, which illustrates how the coupler 10 is attached to a model railroad freight car, will also assist in understanding the structure and function of the various parts of the mounting box. As already noted, the mounting box includes an upper first section 18 and a lower second section 20. The sections of the mounting box are molded from a suitable plastic material, preferably the same material used for the shanks 12 and 14 for ease of manufacture. The upper first section is molded with grooves 80 in its lateral sides, and these grooves accept respective cooperating tongues 82 upstanding from the lateral edges of the lower section 20. The tongues 82 have hooks 83 at their ends that cooperate with catches 86 in the grooves 80 in the upper section. The top surfaces of the hooks 83 are angled and are forced outward during assembly of the mounting box sections by cooperating angled surfaces on the bottoms of the catches 86 to cam the hooks over the catches. The hooks and catches provide a snap-fit that securely holds the mounting box sections 18 and 20 together without the need for an adhesive, which makes them readily separable for repair or replacement of either shank 12 or 14 or the spring 22. Of course, the mounting box sections can be permanently secured together, with or without the cooperating grooves and tongues. As seen in FIG. 4, the tongues 82 present flush outer lateral surfaces on the mounting box when in place in the grooves 80.

In the present embodiment the first mounting box section 18 includes a depending, hollow cylindrical post 84 that is circular in cross section. The outside diameter of the post provides a circular bearing that accepts the openings 33 and 64 in the upper and lower shanks 12 and 14 in a close fit so that each shank is rotatably mounted about the post 84 within the mounting box, as seen in FIG. 4. In other words, the first and second shanks are rotatable relative to each other about an upright axis TA transverse to the direction of travel of the model railroad car along the track (the axis CA). This rotation is between a closed position in which the knuckle and thumb coupler members cooperate with a corresponding coupler on another model railroad car to couple the railroad cars together (as explained below in connection with FIG. 8) and an open position in which the coupler members permit the railroad cars to separate (as explained below in connection with FIG. 9). The grooves 80 and the tongues 82 accurately locate the two mounting box sections 18 and 20 so that the opening 88 through the hollow post 84 aligns with a similar opening 90 through the lower mounting box section 20.

Completing the coupler is a coil spring 22 that in the present embodiment has a circular planform with two full circular turns 100 and 102, shown best in FIG. 6. As seen in FIG. 4, the circular turns of the spring 22 when it is in position have an axis that coincides with the axis TA and a radius that is slightly larger than the outside radii of the circular proximal portion 30 of the upper first shank 12 and the circular proximal portion 60 of the lower second shank 14. The spring 22 has two end portions 104 and 106 that bear against the inside of the sides of the mounting box, as seen in FIG. 4. The spring interlocks with the shanks 12 and 14 at the interlocking offsets 108 and 110. As illustrated by the dot-dash line in FIG. 6, the upper shank interlocking offset 108 fits within the spring-interlock opening 46 in the upper first shank 12. The spring portions proximate to the interlocking offset 108 fit within the upper spring groove 48 and the lower spring groove 50. The position of the spring 22 in the groove 48 is illustrated in FIG. 5; the spring 22 fits within the lower spring groove 50 in the same fashion. Likewise, the lower shank interlocking offset 110 fits within the spring-interlock opening 74 in the lower second shank 14, and the spring portions proximate to the interlocking offset 110 fit within the upper spring groove 76 and the lower spring groove 78. The position of the spring 22 in the groove 76 is illustrated in FIG. 5; the spring 22 fits within the lower spring groove 78 in the same fashion. As a result, the surfaces of the flat proximal portions are in face-to-face contact with the first and second turns of the coil spring disposed outside the periphery of the circular outer surface presented by the flat proximal portions. This can perhaps be best appreciated by considering FIGS. 4 and 5 together.

The mounting box 16 is dimensioned so that the distance between the inside surfaces of the upper section 18 and the lower section 20 is substantially the same as the combined thickness of the flat proximal portion 30 of the upper first shank 12 and the flat proximal portion 60 of the lower second shank 14. The spring grooves 50 and 76 permit the facing surfaces of these proximal portions to lie flush against each other and the offsets 108 and 110 securely interlock the spring 22 with the shanks 12 and 14. That is, the spring grooves 48 and 78 accept the spring 22 to maintain a flush top surface on the flat proximal portion 30 of the upper first shank 12 and a flush bottom surface of the flat proximal portion 60 of the lower second shank 14, so that the two shanks fit within the upper section 18 and the lower section 20 the mounting box. Thus, spring 22 biases the first and second shanks 12 and 14 into their closed state shown in FIG. 4, with the bearing surface 70 on the lower shank 14 in contact with the cooperating bearing surface on the knuckle, as discussed above. In addition, the lost-motion connection between the shanks provided by the pin 72 and the cutout 44 permits slight relative motion between the shanks for coupling/uncoupling operations (described further below) while ensuring that the two shanks rotate together when the rolling stock to which the coupler is attached travels curved track sections. The spring end portions 104 and 106 bearing against the internal surfaces of the mounting box bias the coupler into what is sometimes referred to herein as its "neutral position," in which the longitudinal axes of the shanks are aligned with the longitudinal axis RA of the rolling stock to which it the coupler is mounted (defined as a line running equidistant between the rolling stock wheels, as depicted in FIG. 7). It will also be appreciated that the coupler can be in its closed state, but rotated out of its neutral position while the railroad cars travel a curved section of track.

The spring 22 is preferably made of a metallic material, such as a suitable phosphor bronze spring alloy or similar material. Of course the spring can be made of a suitable plastic material, but one of the advantages of the present invention is that it can avoid the shortcomings of plastic springs in prior art couplers, as discussed above, and still be capable of being made small enough for N scale and Z scale rolling stock. The manner of assembling the shanks 12 and 14 and the spring 22 will be readily apparent to one of ordinary skill in the art. For example, after inserting the straight end portion 106 of the spring into the interlock opening 46 in the upper shank is moved along the spring until the spring interlocking offset 108 enters the opening 46. The other end portion 104 of the spring is inserted into the interlock opening 74 in the lower shank, which is moved along the spring until the spring interlocking offset 110 enters the opening. The two shanks are then moved into their final orientation as shown in FIG. 4 from the top and FIG. 7 from the bottom.

It will be appreciated by now that a coupler according to the present invention avoids the drawbacks of the popular prior art style couplers discussed further above. For example, the pivotable mounting of the shanks according to the depicted embodiment of the invention does not permit relative axial movement between the coupler and the rolling stock to which it is attached. Accordingly, it avoids the delay encountered with Magne-Matic® couplers between the time when the first car of a long train is moved by the locomotive and the start of movement of cars remote from the first car, while also obviating the "Slinky" effect that those couplers can be subject to. It achieves those advantages without using plastic springs and their attendant disadvantages, and can also be made small enough for use with N scale and Z scale model railroads. Finally, it can be made extremely realistic looking in relation to McHenry™ couplers by avoiding their prominent external spring. It also shortens the length of the shanks along the rolling stock axis RA by using the coil spring 22 instead of a compression spring as in the Magne-Matic® couplers. Thus, a coupler according to the present invention need not protrude excessively from the end of the rolling stock, which can result in an unrealistic appearance as well. And these advantages are all present in a coupler that can operate in a manner that simulates real railroading operations to the same extent as prior art couplers.

Other aspects of the present embodiment provide compatibility with prior art designs like those discussed herein. For example, a coupler according to the present invention can be configured so that rolling stock with prior coupler designs like those discussed above can be used with rolling stock having improved couplers as described herein. In addition, the geometry of the shanks permits them to be used with mounting boxes of many types of prior art couplers. For example, the mounting box embodiment shown in FIG. 4 can be configured so that the post 84 is disposed similarly to the post P in the mounting box MB of the Accumate® coupler shown in FIG. 1, whereby an assembled upper shank 12, lower shank 14 and spring 22 can be used with the mounting box MB in the same fashion as in the mounting box 16 shown in FIG. 4. This interchangeability of parts and compatibility with certain prior art configurations greatly enhances the utility of the present invention aside from its inherent operational advantages.

FIG. 7 illustrates the mounting on a model railroad freight car FC of an assembled coupler 10 in accordance with the embodiment of the invention thus far described. A typical item of model rolling stock, such as freight car FC, has two mounting holes MH1 and MH2 on its underside proximate to each end of the car (only one end being shown in the drawing). The holes are centered laterally between the wheels of the car (not shown). Having two holes provides needed flexibility by allowing for the mounting of different coupler styles (for example, see mounting screws S in FIG. 1). The coupler 10 of the presently described embodiment of the invention is configured to use the mounting hole MH1 closer to the end of the car, and thus can be retrofit to most exiting model railroad rolling stock. Another advantage of the construction according to the present embodiment is that the short length of the coupler in the direction of movement of the rolling stock enables it to be installed even on rolling stock with a small mounting area (such as some model locomotives) without protruding unduly from the end of the stock.

The opening 90 in the lower section 20 of the mounting box 16 is countersunk and a beveled mounting screw MS passes though the hole 90 and threads into the mounting hole MH1 to securely fasten the coupler 10 in place on the freight car FC. Another feature of the invention is that the shanks may be placed inside the mounting box with the section 18 on the "bottom" as seen in FIG. 5 and the section 20 on the "top." The opening 88 is countersunk at the outer surface of the section 18 (see FIG. 5), so that the mounting screw MS will lie flush with the outer surface of the section 18 in this configuration as well. In this fashion manufacturing of the coupling, or replacement of coupler parts by a modeler, is facilitated since the orientation of the mounting box holding the shanks is immaterial to the operation and mounting of the coupler. For the same reason, the mounting box is also made symmetrical in the direction of the axis CA (that is, the post 84 is located equidistant from the open ends of the box 22) and in a direction TA (FIG. 4) transverse to the axis CA, so that no particular orientation of the mounting box is required when mounting it to the rolling stock.

Coupling and Uncoupling Operations

In model railroading there are three basic coupling/uncoupling operations. One is a coupling operation in which two uncoupled railroad cars are brought together and coupled. Another is an uncoupling operation in which two coupled cars are separated. The third is a so-called delayed uncoupling operation in which uncoupled cars can be moved to a desired location and left there. All of these operations are preferably capable of being performed at a location remote from a train operator.

Coupling.

FIG. 8 illustrates the stages of an operation coupling two railroad cars on each of which is mounted a coupler according to the embodiment of the invention described herein. FIG. 8, and FIGS. 9 and 10, schematically illustrate a coupler 10 attached to one item of rolling stock and an identical coupler 10' attached to another item of rolling stock. All of the parts of the coupler 10' are denoted with a prime (') to indicate that they are identical to their unprimed counterparts in the coupler 10. The rolling stock is not depicted in these figures for the sake of clarity and certain details of the couplers are omitted (such as structural features of the mounting box described above) for the same reason. The large arrow associated with the coupler 10 in each of FIGS. 8 to 10 indicates that it is attached to a source of locomotion, either a model railroad locomotive or an item of rolling stock attached to a locomotive.

Figure 8A:
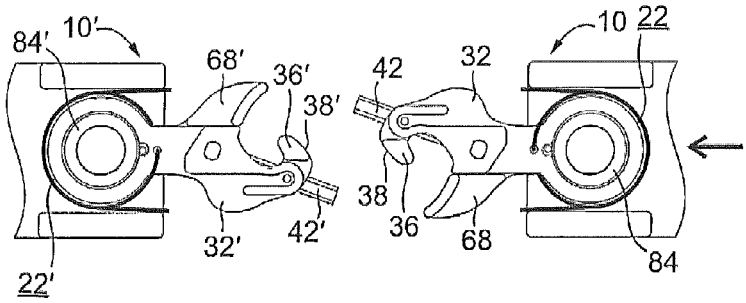
FIG. 8, consisting of FIGS. 8A, 8B, and 8C, shows various positions of the parts of the coupler according to the embodiment depicted in FIGS. 4 to 7, during a coupling operation.
Figure 8B:
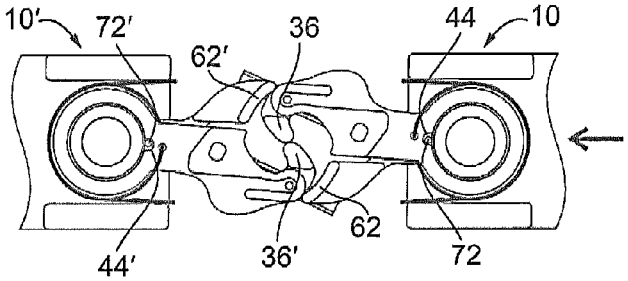
Figure 8C:
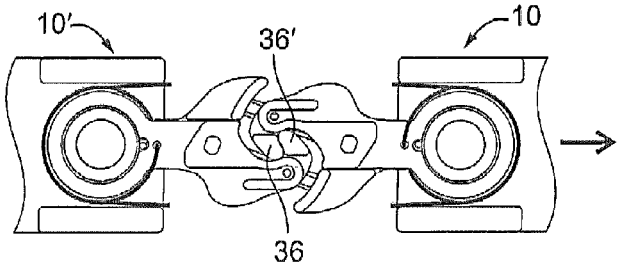

Referring now to FIG. 8A, the coupler 10 is driven toward the coupler 10' as indicated by the arrow, and the distal surface 38 on the knuckle extension 36 of coupler 10 approaches the distal surface 38' on the knuckle extension 36' of the coupler 10'. FIG. 8B shows that the surfaces 38 and 38' have mutually cammed each other laterally so that the outer surface of the knuckle portions 32, 32' of the couplers contacts the inside of the thumb portion 62, 62' of the other coupler. This tends to rotate the upper and lower shanks of each coupler relative to each other about the posts 84, 84'. There is sufficient lost motion between the pin 72, 72' and the cutout 44, 44' in each coupler to permit the shanks to rotate to an open position shown in FIG. 88 so that the knuckle extensions 36, 36' can pass each other. When the knuckle extensions are past each other, the spring 22, acting through its interlock with the shanks as described above, causes the coupler to assume its closed state. The two cars are now coupled together and moving the car to which the coupler 10 is attached in the direction of the arrow in FIG. 8C moves the other car as well. The spring 22 maintains the couplers in their closed position, seen in FIG. 8C, while also permitting the shanks of each coupler to pivot together as the two cars traverse curved track sections.

Uncoupling.

Figure 9A:
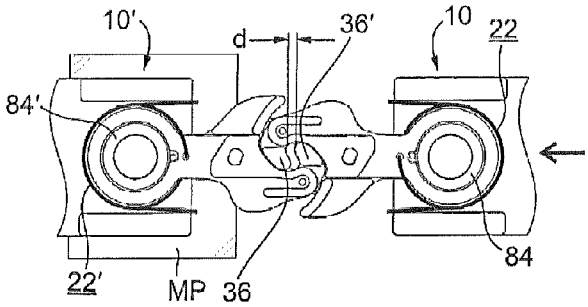
FIG. 9, consisting of FIGS. 9A, 9B, and 9C, shows various positions of the parts of the coupler according to the embodiment depicted in FIGS. 4 to 7, during an uncoupling operation.
Figure 9B:
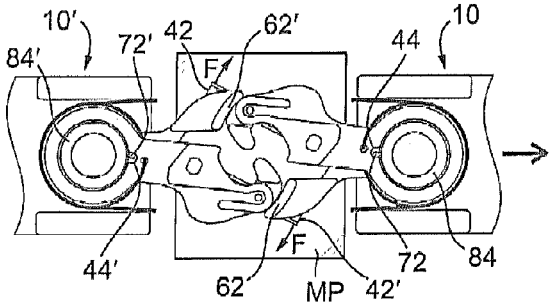

FIG. 9 illustrates an uncoupling operation. Uncoupling is performed by backing two couplers that have been coupled as described in connection with FIG. 8 over a magnetic pad MP located between the train tracks (not shown). FIG. 9A shows the couplers in their coupled state (see FIG. 8C) being backed over the magnetic pad MP by the car on the right in the figure that is attached to a source of locomotion. FIG. 9B shows the couplers directly over the magnetic pad, whereby the actuating pin 42, 42' of each coupler is urged outwardly from the axis of the coupler. As seen in FIG. 9A, the knuckle extensions 36, 36' are axially separated by a distance d because the cars are being backed over the magnetic pad MP. In normal train operation, the hooked configuration of the knuckle extensions 36, 36' maintains them in the coupled state shown in FIG. 8C as the cars are pulled over magnetic pads located in the model train layout at as many uncoupling stations as the operator wishes to provide. In other words, the forward movement of the train keeps the knuckle extensions 36, 36' hooked around each other and resists the separating action of the magnetic pad MP on the actuating pins 42, 42' during forward train movement. It will be appreciated that either or both of the actuating pin or the magnetic pad can be a magnet, while one or the other is a non-magnetized magnetically permeable material. The arrangement shown here is the more conventional one, with the actuating pin being a non-magnetized ferrous material and the magnetic pad being a magnet. Although the magnetic pad is most conventionally a permanent magnet, it can also be an electromagnet.

Figure 9C:
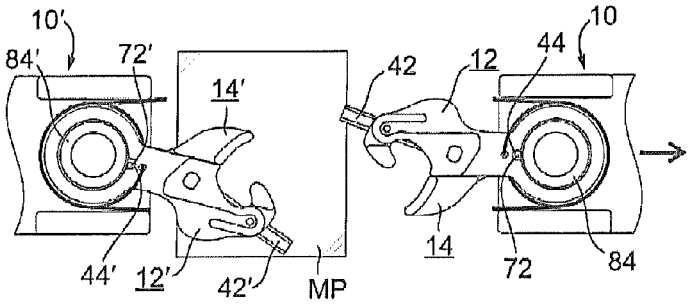

When the couplers reach the position shown in FIG. 9B, directly over the magnetic pad, the force F applied to each actuating pin 42, 42' urges the outer surface of each knuckle portion 32, 32' against the thumb portion 62, 62' of the other coupler, thus causing the two shanks of each coupler to pivot relative to each other in a fashion like that shown in FIG. 8B during a coupling operation. The lost motion connections provided by the pins 72, 72' disposed in the cutouts 44, 44' permit the knuckle extensions 36, 36' to separate laterally from the thumb portions 62, 62' a sufficient distance to permit the knuckles to pass each other as the car on the right is moved in the direction of the arrow in FIG. 9B. The uncoupling operation is completed by moving the car on the right in the direction of the arrow so that it is no longer over the magnetic pad MP. As a result, the coupler 10 returns to its closed state and is in the neutral position, as shown in FIG. 9C. Meanwhile, the coupler 10' remains over the magnetic pad MP, so that the actuating pin 42' still exerts a force pivoting the upper shank 12' clockwise around the post 84'. At this time, the lower shank 14', under the influence of the spring 22', also rotates clockwise to close the coupler 10', with both shanks rotated clockwise against the centering force of the spring, Delayed Uncoupling.

Figure 10A:
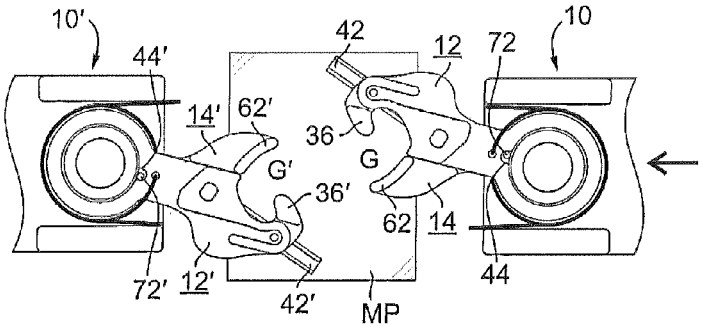
FIG. 10, consisting of FIGS. 10A, 10B, 10C, and 10D, shows various positions of the parts of the coupler according to the embodiment depicted in FIGS. 4 to 7, during a delayed uncoupling operation.

This operation is performed to move an uncoupled car to a desired location. In FIG. 10A the coupler 10' is in the same position as in FIG. 9C, with the car to which it is mounted separated from the reminder of the train, represented by the coupler 10 on the right side of FIG. 10A. The car to which the coupler 10 is mounted is then backed toward the coupler 10', and the magnetic pad MP, acting through the actuating pin 42, rotates the upper shank 12 in a clockwise direction as seen in the figure. Through the action of the spring 22, which is interlocked with both shanks as described above, the lower shank 14 is also rotated so that the coupler 10 is maintained in its closed state even though it is rotated from its neutral position. Thus, both couplers 10 and 10' are rotated clockwise from the centerline of the railroad cars to which they are mounted, but both are in their closed state.

Figure 10B:
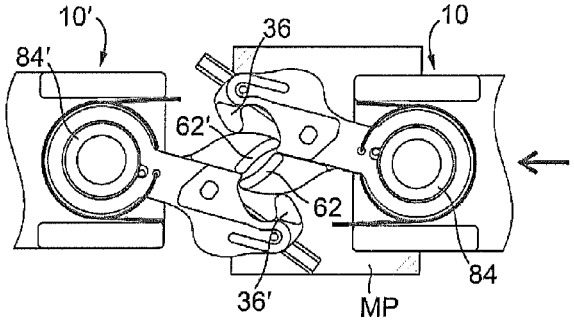
Figure 10C:
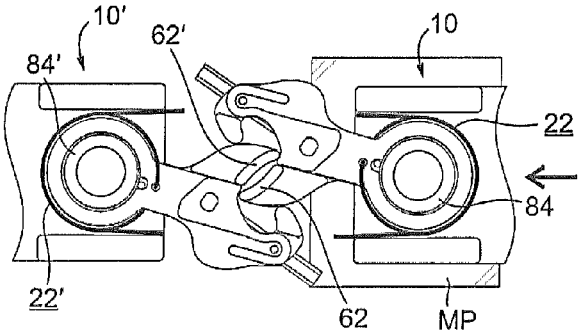
Figure 10D:
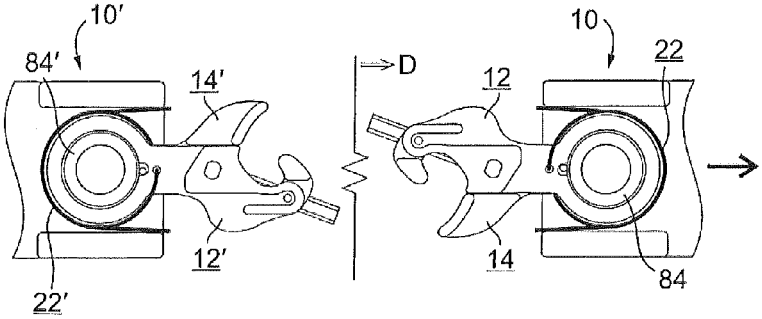

As the coupler 10 continues backing toward the coupler 10', the thumb portion 62 of the coupler 10 enters the gap G' between the knuckle extension 36' and the thumb portion 62' of the coupler 10'. Likewise, the thumb portion 62' of the coupler 10' enters the gap G between the knuckle extension 36 and the thumb portion 62 of the coupler 10. This state is shown in FIG. 10B, and continuing to back the car to which the coupler 10 is mounted in the direction of the arrow in FIGS. 10B and 10C moves both cars to a position in which neither is under the influence of the magnetic pad MP any longer. In the position shown in FIG. 10C the springs 22, 22' in both couplers urge them toward their neutral positions around the posts 84, 84', but each is prevented from returning to that position by the thumb portion of the other. However, as soon as the car on the right is moved in the forward direction as shown by the arrow in FIG. 10D, the coupler 10' can return to its neutral position after the car on the right is moved a sufficient distance D to no longer be positioned with the coupler 10 over the magnetic pad MP. This operation thus delays complete uncoupling of the respective cars to which the couplers 10, 10' are mounted so that the car mounting coupler 10' can be moved to a desired location in the model layout, such as a train yard, for storage. Note also that both couplers in FIG. 10D are in the same state as they were in FIG. 9A, ready for a coupling operation that can retrieve the car to which the coupler 10' is mounted.

SUMMARY

Thus, present invention overcomes many of the shortcomings in prior art model railroad coupling devices and assemblies. As a result of its novel configuration, it can be made to closely resemble various types of actual railroad couplings and provides a realistic operational modality, both in train operations and in its coupling/uncoupling action. It should prove easy and inexpensive to manufacture and find wide acceptance because of its ability to be retrofit to existing model railroad rolling stock and to be used with railroad cars still having popular model railroad couplers available commercially. It can also use mounting structure of different prior art coupler assemblies, thus further increasing its versatility.

While the above description mentions certain variations in the construction and operation of the coupler embodiment thus far described other variations are possible within the scope of the invention. For example, the invention provides the operation advantages discussed above while enabling the coupler shanks to be made in a length that simulates actual couplers to a greater extent than is possible with some prior art designs. In addition, the mounting box can have dimensions or be otherwise configured to accommodate a wide variety of rolling stock, such as passenger cars that often require a longer mounting box (in the direction of car travel CA). Passenger cars also sometimes have special gimbal mounts that accommodate sharp curves in a track layout, and those skilled in the art will readily appreciate that the present invention can be adapted for these and other types of special coupler mounting arrangements.

Those skilled in the art will recognize that only selected preferred embodiments of the invention have been depicted and described, and it will be understood that various changes and modifications can be made other than those specifically mentioned above without departing from the spirit and scope of the invention, which is defined solely by the claims that follow.

What is claimed is:

1. A coupler for a model railroad car, the coupler comprising:

a first shank comprising a distal portion with a first coupler member and a proximal portion with a mounting arrangement for mounting said first shank to the railroad car for rotation about an axis generally transverse to the direction of travel of the model railroad car along a track provided therefor, wherein said proximal portion of said first shank comprises a flat portion having a circular outer surface and a concentric circular opening the center of which coincides with the axis of rotation of said first shank;

a second shank comprising a distal portion with a second coupler member and a proximal portion with a mounting arrangement for mounting said second shank to the railroad car along the track, wherein said first and second shanks are rotatable relative to each other about an axis transverse to the direction of travel of the model railroad car along the track, said first and second shanks being rotatable between a closed position in which said coupler members cooperate with a coupler on another model railroad car to couple the railroad cars together and an open position in which said coupler members permit the railroad cars to separate, and wherein said proximal portion of said second shank comprises a flat portion having a circular outer surface with a radius substantially the same as the radius of said circular outer surface of said first shank flat portion and a concentric circular opening the center of which coincides with the axis of rotation of said first shank with a radius substantially the same as the radius of said circular opening of said first shank flat portion; and a coil spring with an axis generally parallel to the axes of rotation of said first and second shanks and having a first turn interlocked with said first shank and a second turn interlocked with said second shank, said first and second turns terminating in respective first and second end portions for engaging structure on the railroad car to bias said first and second shanks into their dosed position, wherein said coil spring has a circular planform with said first turn including a first interlocking offset that passes through an opening in said first shank and said second turn including a second interlocking offset that passes through an opening in said second shank, said flat portions of said first and second shanks including spring grooves accepting said coil spring to permit said flat portions to be in face-to-face contact and said coil spring having a radius slightly larger than the radius of said circular outer surfaces of said first and second shanks so that said first and second turns of said coil spring are disposed outside the periphery of said circular outer surfaces.

2. A coupler as in claim 1, wherein said first turn of said coil spring is interlocked with said first shank intermediate to the distal and proximal portions thereof, and said second turn of said coil spring is interlocked with said second shank intermediate to the distal and proximal portions thereof.

3. A coupler as in claim 1, wherein said first and second shanks include a lost-motion connection therebetween that limits the amount by which said first and second shanks can rotate relative to each other into their open position.

4. A coupler as in claim 3, wherein said lost-motion connection includes a cutout at the periphery of said circular opening of one of said first and second shanks and a pin on the other of said first and second shanks, said pin being disposed in said cutout and having a smaller dimension in the circumferential direction of said opening than said cutout.

5. A coupler as in claim 3, wherein said first and second shanks comprise cooperating stop structure that limits the amount by which said first and second shanks can rotate relative to each other into their dosed position.

6. A coupler as in claim 5, wherein said stop structure includes a surface on said first coupling member and a surface on said second coupling member that is urged into contact with said surface on said first coupling member by said spring.

7. A coupler as in claim 3, further including a magnetic actuating pin mounted on one of said first and second shanks for causing rotation thereof against the biasing force of said spring when a railroad car to which the coupler is mounted is at a location on the track with said actuating pin proximate to a magnetic actuating pad.

8. A coupler as in claim 7, wherein:

said distal portion of said first shank comprises a coupler knuckle having said actuating pin mounted thereto and said distal portion of said second shank comprises a coupler thumb; and said first shank is on top of said second shank when said coupler is in position on the railroad car and the railroad car is on the track.

9. A coupler as in claim 8, wherein said lost-motion connection includes a cutout at the periphery of said circular opening of said first shank and a pin on second shank, said pin being disposed in said cutout and having a smaller dimension in the circumferential direction of said opening than said cutout.

10. A coupler as in claim 7, wherein said magnetic actuating pin is a non-magnetized magnetic magnetically permeable material and the magnetic actuating pad comprises a magnet.

11. A coupler assembly for a model railroad car, the assembly comprising:

a first shank comprising a distal portion with a coupler knuckle and a proximal portion including a flat portion having a circular outer surface and a concentric circular opening;

a second shank comprising a distal portion with a coupler thumb and a proximal portion including a flat portion having a circular outer surface with a radius substantially the same as the radius of said circular outer surface of said first shank flat portion and a concentric circular opening the center of which substantially coincides with the center of said circular opening in said first shank;

a coil spring with to circular planform having a first turn and a second turn terminating in respective first and second end portions, said first turn including a first interlocking offset that passes through an opening in said first shank and said second turn including a second interlocking offset that passes through an opening in said second shank and said flat portions of said first and second shanks including spring grooves accepting said coil spring to permit said flat portions to lie in face-to-face contact, wherein said coil spring has a radius slightly larger than the radius of said circular outer surfaces of said first and second shanks so that said first and second turns of said coil spring are disposed outside the periphery of said circular outer surfaces; and a mounting box for mounting to the railroad car and having a circular mounting post with an upright axis generally perpendicular to the direction of travel of the model railroad car along a track and generally perpendicular to a plane of the track when the model railroad car is in place thereon, said mounting post accepting said circular openings in said first and second shanks for permitting rotation of said shanks relative to each other about the upright axis between a closed position in which said knuckle and thumb cooperate with a coupler on another model railroad car to couple the railroad cars together and an open position in which said knuckle and thumb permit the railroad cars to separate, wherein said first and second end portions of said coil spring engage said mounting box to bias said shanks into their closed position and into a position in which said shanks are generally aligned with the direction of travel of the model railroad car along the track.

12. A coupler assembly as in claim 11, wherein said first and second shanks include a lost-motion connection therebetween that limits the amount by which said first and second shanks can rotate relative to each other into their open position.

13. A coupler assembly as in claim 12, wherein said lost motion connection includes a cutout at the periphery of said circular opening of said first shank and a pin on said second shank disposed in said cutout and having a smaller dimension in the circumferential direction of said opening than said cutout.

14. A coupler assembly as in claim 12, wherein said knuckle includes a first stop surface generally perpendicular to the direction of travel of the model railroad car along the track and generally perpendicular to a plane of the track when the model railroad car is in place thereon; and said thumb includes a second stop surface generally parallel to said first stop surface, said second stop surface being urged into contact with said first stop surface by said spring.

15. A coupler assembly as in claim 14, further including a magnetic actuating pin of a non-magnetized magnetically permeable material mounted on said knuckle for causing rotation of said first shank against the biasing force of said spring when a railroad car to which the coupler assembly is mounted is at a location on the track with said magnetic actuating pin proximate to a magnetic actuating pad comprising a magnet.

16. A coupler as in claim 15, wherein said first shank is on top of said second shank when said coupler is in position on the railroad car and the railroad car is on the track.

17. A coupler assembly as in claim 15, wherein:

said mounting box includes a first section and a second section that is removably snap-fitted to said first section for permitting replacement of said shanks;

said first and second sections present upper and lower internal surfaces spaced apart a distance substantially equal to the thickness of said face-to-face flat shank portions, with said ends of said biasing spring engaging transverse sides of said mounting box; and said mounting post spans said upper and lower internal surfaces and is hollow for accepting a mounting screw therethrough for securing said mounting box to the railroad car.

18. A coupler assembly as in claim 15, wherein:

said knuckle includes a knuckle extension extending toward said thumb and a knuckle distal end presents a camming surface for cooperating with a corresponding camming surface on a distal end of a corresponding coupler knuckle part on the other railroad car to rotate said first shank against the biasing force of the coil spring as said railroad cars are moved into proximity along the track;

said corresponding coupler knuckle part has a knuckle extension extending toward a coupler thumb part, the corresponding coupler knuckle part cooperating with said coupler thumb to rotate said coupler thumb against the biasing force of said spring as said railroad cars are moved further together to permit said knuckle extension to pass the knuckle extension on the corresponding coupler knuckle part; and said coil spring rotates said first and second shanks to their closed position when knuckle extensions have passed each other, said knuckle extensions cooperating to couple the cars together.

19. A coupler assembly as in claim 18, wherein:

actuating pins on two coupled railroad cars rotate a first shank of each car in a direction separating corresponding first shanks and second shanks against the biasing force of corresponding springs when said actuating pins are proximate to the magnetic actuating pad; and rotation of each first shank by a corresponding actuating pin causes said knuckle portion of said first shank of one of the coupled railroad cars to engage the coupler thumb of the other coupled railroad car to separate the knuckle extension and coupler thumb of each railroad car a sufficient distance to permit said knuckle extensions to pass each other in the direction of travel of the railroad cars on the track.

* * * * *

UNITED STATES PATENT AND TRADEMARK OFFICE

CERTIFICATE OF CORRECTION

PATENT NO. : 8,720,710 B2
APPLICATION NO. : 13/437029
DATED : May 13, 2014
INVENTOR(S) : David K. Smith It is certified that error appears in the above-identified patent and that said Letters Patent is hereby corrected as shown below:

In the Claims

Column 14, line 34, should read:

-- *road car for rotation about an axis generally transverse to the direction of travel of the railroad car along the track, wherein said first and second* --

Column 14, line 57, should read:

-- *said first and second shanks into their closed position,* --

Signed and Sealed this
Eighth Day of July, 2014

Michelle K. Lee

Michelle K. Lee
*Deputy Director of the United States Patent and Trademark Office*